US008491090B2

(12) United States Patent
Park

(10) Patent No.: US 8,491,090 B2
(45) Date of Patent: Jul. 23, 2013

(54) IMAGE FORMING APPARATUS

(75) Inventor: Soyoung Park, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/399,299

(22) Filed: Feb. 17, 2012

(65) Prior Publication Data

US 2012/0224001 A1 Sep. 6, 2012

(30) Foreign Application Priority Data

Mar. 2, 2011 (JP) ..... 2011-044730

(51) Int. Cl.
*B41J 2/165* (2006.01)

(52) U.S. Cl.
USPC ..... 347/30

(58) Field of Classification Search
USPC ..... 347/30, 22, 29, 90
See application file for complete search history.

(56) References Cited

U.S. PATENT DOCUMENTS

2006/0176333 A1* 8/2006 Momose et al. ..... 347/30
2008/0143778 A1* 6/2008 Sugiyama et al. ..... 347/23

FOREIGN PATENT DOCUMENTS

JP 9-254401 9/1997
JP 2004-98408 4/2004
JP 2010-162791 7/2010

OTHER PUBLICATIONS

U.S. Appl. No. 13/217,431, filed Aug. 25, 2011.
U.S. Appl. No. 13/222,164, filed Aug. 31, 2011.
U.S. Appl. No. 13/289,070, filed Nov. 4, 2011.
U.S. Appl. No. 13/297,677, filed Nov. 16, 2011.

* cited by examiner

*Primary Examiner* — Matthew Luu
*Assistant Examiner* — Michael Konczal
(74) *Attorney, Agent, or Firm* — Cooper & Dunham LLP

(57) ABSTRACT

An image forming apparatus including a recording head having an array of nozzles disposed on a nozzle face of the recording head, a suction cap to cover the nozzle face of the recording head, a cap holder movable relative to the recording head to movably hold the suction cap, an induction member provided between the cap holder and the suction cap to receive liquid dropping from the suction cap, and a discharge channel connected to the induction member through which the liquid retained by the induction member is discharged externally. The suction cap is first removed from the nozzle face of the recording head while the induction member still remains in contact with the nozzle face of the recording head so that the induction member receives liquid dropping from the suction cap upon retraction of the cap holder from the recording head.

6 Claims, 6 Drawing Sheets

IMAGE FORMING APPARATUS

CROSS-REFERENCE TO RELATED APPLICATION

The present patent application is based on and claims priority pursuant to 35 U.S.C. §119 from Japanese Patent Application No. 2011-044730, filed on Mar. 2, 2011 in the Japan Patent Office, which is incorporated by reference herein in its entirety.

BACKGROUND OF THE INVENTION

1. Field of the Invention

Exemplary aspects of the present invention generally relate to an image forming apparatus, and more particularly to an image forming apparatus including a recording head that ejects liquid droplets.

2. Description of the Related Art

One example of related-art image forming apparatuses such as printers, copiers, plotters, facsimile machines, and multifunction devices having two or more of printing, copying, plotting, and facsimile capabilities is an inkjet recording device employing a liquid ejection recording method. The inkjet recording device includes a recording head that ejects droplets of a recording liquid such as ink from nozzles in the recording head onto a sheet of recording media while the sheet is conveyed to form an image on the sheet. Examples of an inkjet recording device include a serial-type image forming apparatus, in which the recording head ejects ink droplets while moving in a main scanning direction to form an image on the sheet as the sheet is moved in a sub-scanning direction perpendicular to the main scanning direction, and a line-type image forming apparatus equipped with a line-type recording head that ejects ink droplets and does so without moving to form an image on the sheet as the sheet is moved in the sub-scanning direction.

The inkjet recording device further includes a servicing mechanism to maintain stable ejection of ink droplets from the nozzles in the recording head (i.e., to keep the nozzles clean). The servicing mechanism includes a cap that caps a nozzle face of the recording head (i.e., the face of the recording head in which the nozzles are disposed) to prevent ink within the nozzles from getting dried out and clogging the nozzles and dust and foreign substances from entering the nozzles, a wiper that wipes off the nozzle face of the recording head to clean the nozzle face, and so forth. After viscous ink is discharged from the nozzles into the cap that covers the nozzle face, the wiper wipes off the nozzle face to form a meniscus at the nozzles, thereby servicing the recording head.

There is known a servicing mechanism including a suction cap movable in a horizontal direction to cover the nozzle face of the recording head disposed in a vertical direction. The suction cap includes an escape opening provided at an upper portion thereof and a suction opening provided at a lower portion thereof.

In order to prevent leakage of ink from the suction cap during suction of ink from the nozzles in the recording head, first, the nozzle face is capped with the suction cap, next, ink is sucked out from the nozzles to the suction cap, then, a space enclosed within the suction cap is opened to the atmosphere so that the ink is discharged from the suction cap via the suction opening, and finally, the suction cap is removed from the nozzle face of the recording head.

However, because a slight amount of ink sucked out from the nozzles to the suction cap remains within the suction cap even after discharge of the ink from the suction cap, the ink may drop from the suction cap upon removal of the suction cap from the nozzle face of the recording head, resulting in adhesion of the ink to a cap holder. In addition, the ink adhering to the suction cap may prevent the suction cap from properly covering the nozzle face and forming the enclosed space between the nozzle face and the suction cap. Consequently, the nozzles may get dried out and clogged with viscous ink, resulting in deterioration of the suction performance for servicing the nozzles.

BRIEF SUMMARY OF THE INVENTION

In view of the forgoing, illustrative embodiments of the present invention provide a novel image forming apparatus including a recording head in which a nozzle face is vertically disposed to prevent waste ink from dropping from a cap onto a cap holder or the like upon removal of the cap from the nozzle face.

In one illustrative embodiment, an image forming apparatus includes a recording head having an array of nozzles disposed on a nozzle face of the recording head to eject liquid droplets from the nozzles, a suction cap to cover the nozzle face of the recording head and having a contact portion to contact the nozzle face of the recording head, a cap holder movable relative to the recording head to movably hold the suction cap and having an elastic member connected to the suction cap and a guide member to slidably contact a lower outer wall of the recording head, an induction member provided between a lower inner wall of the cap holder and a lower outer wall of the suction cap to receive liquid dropping from the suction cap, and a discharge channel connected to the induction member through which the liquid retained by the induction member is discharged externally. The nozzle face of the recording head is arranged vertically in the image forming apparatus. The suction cap is first removed from the nozzle face of the recording head while the induction member still remains in contact with the nozzle face of the recording head so that the induction member receives liquid dropping from the suction cap upon retraction of the cap holder from the recording head.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
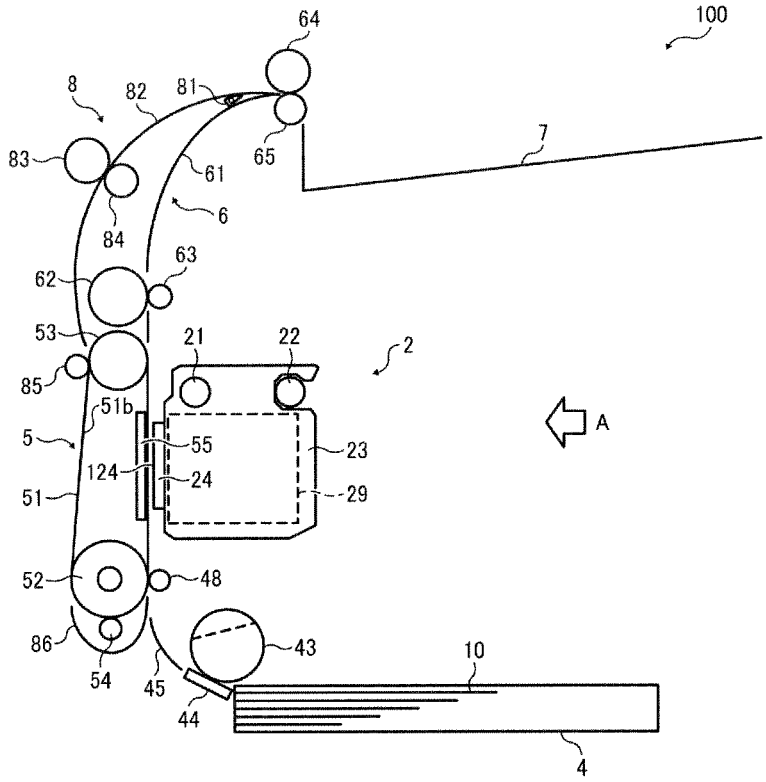
FIG. 1 is a schematic vertical cross-sectional view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Image forming apparatuses hereinafter described form an image on a recording medium, such as paper, string, fiber, cloth, lather, metal, plastics, glass, wood, and ceramics by ejecting ink droplets onto the recording medium. In this specification, an "image" refers to both signifying images, such as characters and figures, as well as a non-signifying image such as patterns, and moreover is not limited to a flat image, but also includes an image formed on a three-dimensional object, a three-dimensional image, and so forth. In addition, the term "ink" includes any material which is a liquid when ejected from the image forming apparatuses to form images on the recording medium. A "sheet" of recording media is not limited to a sheet of paper but also includes any material onto which ink droplets adhere, such as an OHP sheet and the examples of the recording media described above.

Figure 2:
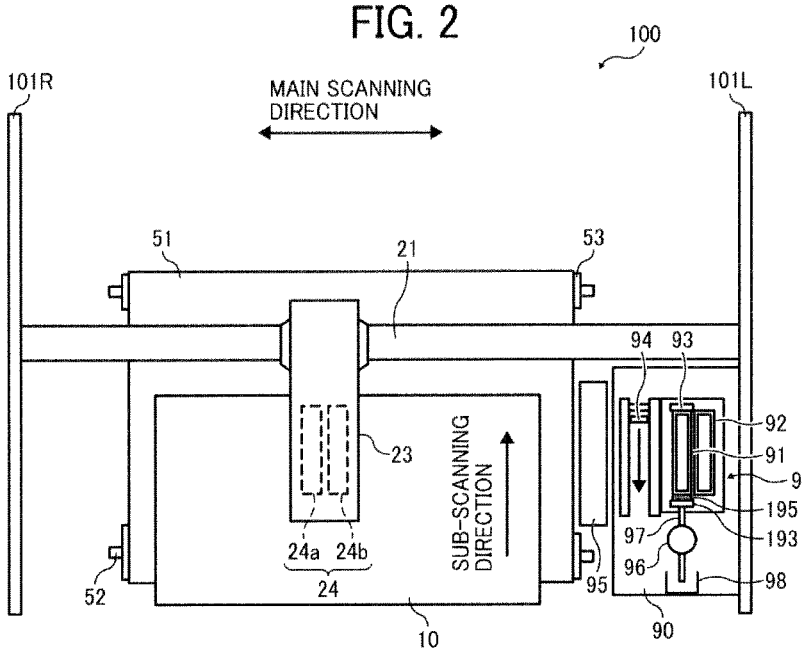
FIG. 2 is a schematic view illustrating the configuration of the image forming apparatus viewed from a direction indicated by arrow A in FIG. 1.

A configuration and operation of an image forming apparatus 100 according to illustrative embodiments are described below, with reference to FIGS. 1 and 2. The image forming apparatus 100 is a serial-type inkjet recording device including recording heads 24*a* and 24*b* described in detail later. FIG. 1 is a schematic vertical cross-sectional view illustrating an example of a configuration of the image forming apparatus 100 according to illustrative embodiments. FIG. 2 is a schematic view illustrating the configuration of the image forming apparatus 100 viewed from a direction indicated by arrow A in FIG. 1.

The image forming apparatus 100 includes an image forming unit 2, a conveyance mechanism 5, a sheet feeder 4 provided at a bottom portion thereof, and so forth. The sheet feeder 4 includes a sheet feed cassette that stores a recording medium such as a sheet 10. The sheet 10 fed from the sheet feeder 4 is intermittently conveyed to the image forming unit 2 in a vertical direction by the conveyance mechanism 5 so that the image forming unit 2 ejects ink droplets horizontally onto the sheet 10 to form an image on the sheet 10. The sheet 10 having the image thereon is then further conveyed upward through a discharge unit 6 and is discharged to a discharge tray 7 provided at an upper portion of the image forming apparatus 100.

During duplex image formation, the sheet 10 having the image on a front side thereof is conveyed from the discharge unit 6 to a reversal unit 8. Accordingly, the sheet 10 is conveyed downward to the conveyance mechanism 5 to be reversed so that an image is formed on a back side of the sheet 10 by the image forming unit 2. The sheet having the images on both sides thereof is then discharged to the discharge tray 7 via the discharge unit 6.

In the image forming unit 2, a carriage 23 in which the recording heads 24*a* and 24*b* (hereinafter collectively referred to as a recording head 24 when not distinguished from each other) are installed is slidably supported by a main guide member 21 and a sub-guide member 22, both extended between right and left lateral plates 101R and 101L and parallel to each other. The carriage 23 is reciprocally movable back and forth in a main scanning direction by a main scanning motor, not shown, via a timing belt wound around a drive pulley and a driven pulley.

The recording heads 24*a* and 24*b*, each constituted of a liquid ejection head that ejects ink droplets of a specific color, that is, yellow (Y), magenta (M), cyan (C), or black (K), are installed on the carriage 23 such that nozzle arrays each constituted of multiple nozzles 120 are arrayed in a nozzle face 124 of each of the recording heads 24*a* and 24*b* in a sub-scanning direction perpendicular to the main scanning direction to eject ink droplets of the specified colors in a horizontal direction. In other words, the image forming apparatus 100 employs a horizontal ejection method, in which the recording head 24 includes the nozzle face 124 vertically disposed so that the ink droplets are ejected from the nozzles 120 in the horizontal direction.

The recording head 24 has two nozzle arrays provided parallel to each other to eject ink droplets of different colors, respectively. Specifically, yellow ink droplets (Y) are ejected from a first nozzle array formed in the recording head 24*a*, and magenta ink droplets (M) are ejected from a second nozzle array formed therein. Black ink droplets (K) are ejected from a first nozzle array formed in the recording head 24*b*, and cyan ink droplets (C) are ejected from a second nozzle array formed therein.

A head tank 29 is also installed in the carriage 23 to supply ink of the specified colors to the corresponding nozzle arrays in the recording head 24. Ink is supplied to the head tank 29 from a main tank for each color detachably attached to the image forming apparatus 100.

A sheet feed roller 43 and a separation pad 44, both provided to the sheet feeder 4, separate the sheets 10 one by one to feed each of the sheets 10 between a conveyance belt 51 included in the conveyance mechanism 5 and a pressing roller 48 via a guide member 45. The sheet 10 is attracted to and conveyed by the conveyance belt 51.

The conveyance mechanism 5 includes the endless conveyance belt 51 wound around a conveyance roller 52 and a driven roller 53, a charging roller 54 that charges the conveyance belt 51, a platen member 55 that flattens the conveyance belt 51 opposite the image forming unit 2, and so forth. The conveyance roller 52 is rotatively driven by a sub-scanning motor of a sub-scanning drive mechanism, not shown, via a timing belt and a timing pulley to rotate the conveyance belt 51 in the sub-scanning direction, that is, a direction of conveyance of the sheet 10.

The discharge unit 6 includes a discharge guide member 61, a discharge conveyance roller 62, a first spur 63, a discharge roller 64, and a second spur 65. The sheet 10 having the image thereon is discharged between the discharge roller 64 and the second spur 65 to the discharge tray 7, with the side having the image thereon facing down in the case of simplex image formation.

The reversal unit 8 includes a changeover pick 81 that switches a direction of conveyance of the sheet 10 between a discharge path and a reversal path. Specifically, the changeover pick 81 reverses the direction of conveyance of the sheet 10, a part of which is discharged to the discharge tray 7, using a switchback system so that the sheet 10 is conveyed backward between the conveyance belt 51 and the pressing roller 48. The reversal unit 8 further includes a reversal guide member 82, a reversal roller 83, a third spur 84, a driven auxiliary roller 85 provided opposite the driven roller 53, a reversal conveyance part 51*b* of the conveyance belt 51, and a diversion guide member 86 that diverts the sheet 10 separated from the reversal conveyance part 51*b* of the conveyance belt 51 to the charging roller 54 so as to guide the sheet 10 between the conveyance belt 51 and the pressing roller 48.

A servicing mechanism 9 that services the nozzles 120 in the recording head 24 is provided outside the imaging range of the image forming unit 2 in the main scanning direction. The servicing mechanism 9 is constructed of a frame 90, a suction cap 91 and a moisture retention cap 92, each of which covers the nozzle face 124 of the recording head 24, and a wiper blade 94 that wipes off the nozzle face 124, all of which are supported by the frame 90. The suction cap 91 is held by a cap holder 93. The servicing mechanism 9 further includes an ink receiver 95 that receives ink droplets not used for image formation and preliminarily ejected from the nozzles 120 to remove coagulated ink. The suction cap 91 is connected to a suction/discharge channel 97 having a suction unit, which, in the present illustrative embodiment, is a suction pump 96. The suction/discharge channel 97 is further connected to a waste tank 98.

A stepping motor, not shown, for a capping mechanism is provided inside the frame 90 of the servicing mechanism 9. Forward rotation of the stepping motor caps and decaps the nozzle face 124 of the recording head 24 with the suction cap 91 or the moisture retention cap 92 in conjunction with the cap holder 93 or a moisture retention cap holder, not shown, via gears and cams, not shown. Reverse rotation of the stepping motor drives the suction pump 96.

As described previously, the sheet 10 fed from the sheet feeder 4 is electrostatically attracted to the conveyance belt 51 charged by the charging roller 54 to be conveyed in the vertical direction as the conveyance belt 51 rotates. The recording heads 24*a* and 24*b* are driven based on image signals while the carriage 23 is moved so that ink droplets are ejected from the recording heads 24*a* and 24*b* onto the sheet 10, which remains stationary, so as to form a single line in an image to be formed on the sheet 10. Thereafter, the conveyance mechanism 51 conveys the sheet 10 by a predetermined amount to perform image formation of the next line. Upon completion of image formation, the sheet 10 having the image thereon is discharged to the discharge tray 7.

The carriage 23 is moved to a home position to face the servicing mechanism 9 during servicing of the nozzles 120 in the recording head 24. The nozzle face 124 of the recording head 24 is capped with the suction cap 91 so that coagulated ink is sucked out from the nozzles 120 into the suction cap 91 and ink droplets not used for image formation are idly discharge from the nozzles 120 to the suction cap 91 so as to service the nozzles 120, thereby providing stable ejection of ink droplets from the recording head 24 and achieving higher-quality image formation.

During duplex image formation, after the image is formed on the front side of the sheet 10 with the processes described above, the discharge roller 64 is reversely driven when a trailing edge of the sheet 10 passes the changeover pick 81. As a result, the sheet 10 is guided backward to the reversal guide member 82 and is further conveyed by the reversal roller 83 and the third spur 84 between the reversal conveyance part 51*b* of the conveyance belt 51 and the driven auxiliary roller 85.

The sheet 10 is attracted to the reversal conveyance part 51*b* of the conveyance belt 51 and is conveyed as the conveyance belt 51 rotates. The sheet 10 is then separated from the reversal conveyance part 51*b* of the conveyance belt 51 at the conveyance roller 52 to be guided to the diversion guide member 86. Thereafter, the sheet 10 is again conveyed between the conveyance belt 51 and the pressing roller 48, attracted to the conveyance belt 51, and further conveyed to the imaging range of the image forming unit 2 again. After an image is formed on the back side of the sheet 10 by the image forming unit 2, the sheet 10 is discharged to the discharge tray 7.

Figure 3:
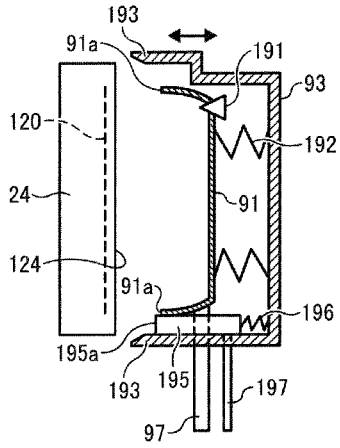
FIG. 3 is a schematic view illustrating an example of a configuration of a capping mechanism provided to a servicing mechanism of an image forming apparatus according to a first illustrative embodiment.

A description is now given of a configuration and operation of the capping mechanism included in the servicing mechanism 9 according to a first illustrative embodiment, with reference to FIGS. 3 to 6. FIG. 3 is a schematic view illustrating an example of a configuration of the capping mechanism included in the servicing mechanism 9 according to the first illustrative embodiment. FIGS. 4A to 4D are schematic views respectively illustrating transitional states of the capping mechanism during suction of ink according to the first illustrative embodiment. FIGS. 5A to 5D are schematic views respectively illustrating transitional states of the capping mechanism that follow after the state illustrated in FIG. 4D. FIGS. 6A and 6B are schematic views illustrating transitional states of the capping mechanism that follow after the state illustrated in FIG. 5D.

The suction cap 91 has an escape opening 191*a* connected to an escape valve 191 that opens a space enclosed within the suction cap 91 to the atmosphere while the nozzle face 124 is capped with the suction cap 91, and a discharge opening, not shown, connected to the suction/discharge channel 97 to discharge waste ink from the suction cap 91. The escape opening 191*a* is provided to an upper portion of the suction cap 91, and the discharge opening is provided to a lower portion of the suction cap 91. It is to be noted that the escape opening 191*a* may be disposed either vertically or horizontally.

The suction cap 91 is held by the cap holder 93, which is movable in the horizontal direction, such that the suction cap 91 is movable relative to the cap holder 93 via an elastic member, which, in the present illustrative embodiment, is a spring 192.

The cap holder 93 has a guide member 193 that slidably contacts upper and lower surfaces of the recording head 24 when the suction cap 91 covers the nozzle face 124 of the recording head 24. The guide member 193 slidably contacts the upper and lower surfaces of the recording head 24 to position the suction cap 91 relative to the nozzle face 124.

An induction member 195 that receives waste toner dropping from a lower edge of the suction cap 91 upon removal of the suction cap 91 from the nozzle face 124 of the recording head 24 is movably disposed between a lower inner wall of the cap holder 93 and a lower outer wall of the suction cap 91. The induction member 195 is connected to a discharge channel 197 through which the waste ink retained by the induction member 195 is discharged outside. A biasing member, which, in the present illustrative embodiment, is a spring 196 that biases the induction member 195 toward the recording head 24, is provided between the induction member 195 and the cap holder 93.

A first face of the induction member 195, which, in the present illustrative embodiment, is a contact face 195*a* that contacts the nozzle face 124 of the recording head 24, protrudes beyond a contact portion 91*a* of the suction cap 91 that contacts the nozzle face 124. Although the induction member 195 need not be entirely formed of an elastic material, it is preferable that at least the contact face 195*a* be formed of an elastic material in order to prevent damage to the nozzle face 124 when contacting the nozzle face 124.

Cleaning operation to service the recording head 24 is performed when the nozzles 120 in the recording head 24 are clogged or a meniscus at the nozzles 120 is destroyed due to a loss of negative pressure within the head tank 29. Cleaning of the recording head 24 includes the steps of sucking out coagulated ink from the nozzles 120, wiping off the nozzle face 124, and idly ejecting ink droplets not used for image formation but instead simply to clear the nozzles 120.

The suction process is performed in the following order: Capping the nozzle face 124 with the suction cap 91, sucking out coagulated ink from the nozzles 120 into the suction cap 91, opening the escape valve 191, discharging the waste ink from the suction cap 91, and removing the suction cap 91 from the nozzle face 124. The suction process is described in detail below with reference to FIGS. 4 to 6.

Figure 4A:
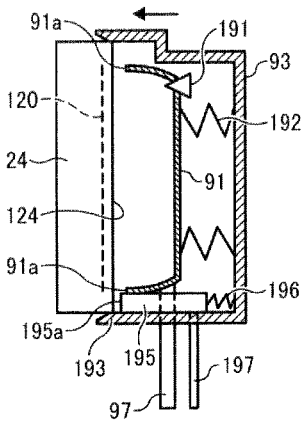
FIGS. 4A to 4D are schematic views respectively illustrating transitional states of the capping mechanism during suction of ink according to the first illustrative embodiment.
Figure 4B:
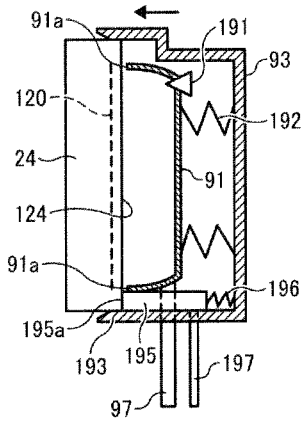
Figure 4C:
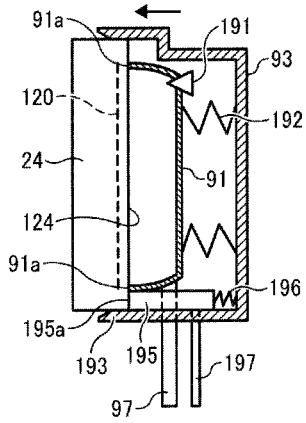
Figure 4D:
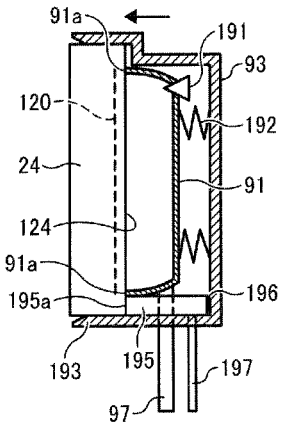

First, the stepping motor, not shown, is driven to move the cap holder 93 from a retracted position illustrated in FIG. 3 toward the recording head 24 as illustrated in FIG. 4A so that the guide member 193 of the cap holder 93 slides against the upper and lower surfaces of the recording head 24. Accordingly, first, the contact face 195*a* of the induction member 195 contacts the nozzle face 124 as illustrated in FIG. 4B, and then the contact portion 91*a* of the suction cap 91 contacts the nozzle face 124 as illustrated in FIG. 4C. The cap holder 93 is further moved toward the recording head 24 as illustrated in FIG. 4D so that the nozzle face 124 is securely capped with the suction cap 91 to form a sealed space within the suction cap 91.

Figure 5A:
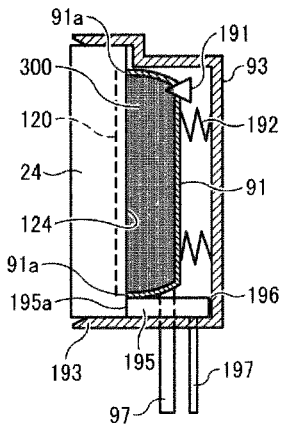
FIGS. 5A to 5D are schematic views respectively illustrating transitional states of the capping mechanism that follow after the state illustrated in FIG. 4D.
Figure 5B:
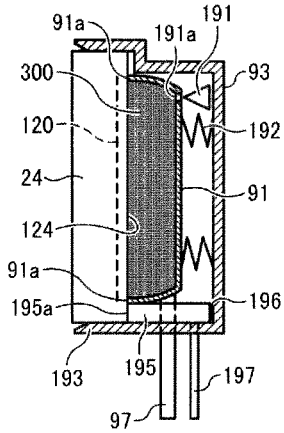
Figure 5C:
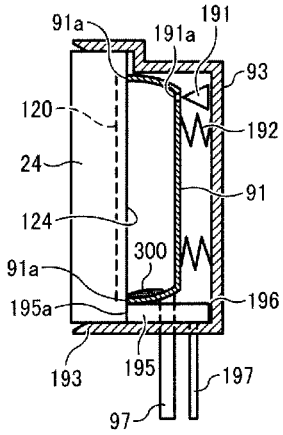

Next, the suction pump 96 is driven to suck out a predetermined amount of ink from the nozzles 120 to discharge waste ink 300 into the suction cap 91 as illustrated in FIG. 5A. At this time, the escape valve 191 is opened to open the space enclosed within the suction cap 91 to the atmosphere as illustrated in FIG. 5B. Then, the suction pump 96 is driven again under the state illustrated in FIG. 5B so that the waste ink 300 is discharged from the suction cap 91 to the waste tank 98 via the suction/discharge channel 97 as illustrated in FIG. 5C. Because the waste toner 300 within the suction cap 91 cannot be fully discharged to the waste tank 98, a part of the waste ink 300 remains at the bottom of the suction cap 91.

Figure 5D:
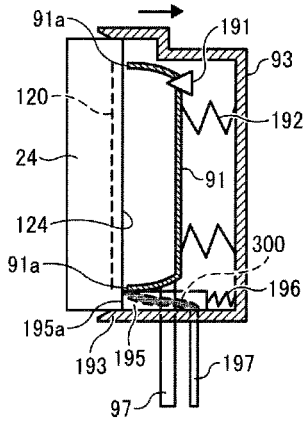

Under this condition, the stepping motor is reversely driven to retract the cap holder 93 from the recording head 24 so that the contact portion 91*a* of the suction cap 91 is first removed from the nozzle face 124 as illustrated in FIG. 5D.

At this time, because the contact face 195*a* of the induction member 195 that protrudes toward the nozzle face 124 beyond the contact portion 91*a* is not yet removed from the nozzle face 124, the waste ink 300 remaining within the suction cap 91 drops from the contact portion 91*a* and is retained by the induction member 195. The waste ink 300 thus retained is then inducted by the induction member 195 to the discharge channel 197. Accordingly, the waste ink 300 does not drop on the guide member 193 of the cap holder 93.

Figure 6A:
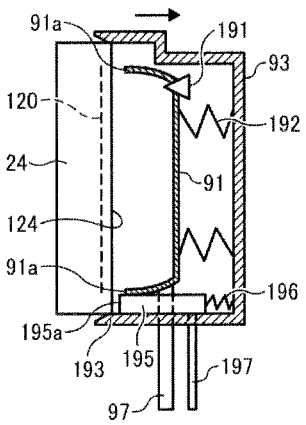
FIGS. 6A and 6B are schematic views respectively illustrating transitional states of the capping mechanism that follow after the state illustrated in FIG. 5D.
Figure 6B:
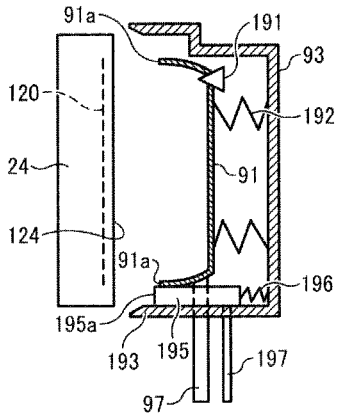

Thereafter, retraction of the cap holder 93 from the recording head 24 removes the induction member 195 from the nozzle face 124 as illustrated in FIG. 6A. Finally, the guide member 193 of the cap holder 93 is removed from the recording head 24 as illustrated in FIG. 6B to complete decapping operation.

Next, the carriage 23 is moved to a wiping position so that the wiper blade 94 wipes off the nozzle face 124 of the recording head 24. Thereafter, the carriage 23 is moved to the ink receiver 95 so that ink droplets not used for image formation are idly ejected from the nozzles 120 into the ink receiver 95 to complete cleaning of the recording head 24.

Thus, the induction member 195 remains in contact with the nozzle face 124 even when the contact portion 91*a* of the suction cap 91 is removed from the nozzle face 124. Therefore, even when a large proportion of the waste ink 300 discharged to the suction cap 91 remains within the suction cap 91 after discharge of the waste ink 300 to the waste tank 98 depending on usage and the waste ink 300 drops from the suction cap 91 upon removal of the suction cap 91 from the nozzle face 124, the induction member 195 reliably receives the waste ink 300 dropping from the suction cap 91. The waste ink 300 thus retained by the induction member 195 is then discharged to the waste tank 98 through the discharge channel 197. Accordingly, the waste ink 300 is prevented from dropping and adhering onto the guide member 193 of the cap holder 193. Further, the waste ink 300 accidentally dropping from the suction cap 91 due to a sudden loss of power or the like during suction of the ink can be reliably retained by the induction member 195 and discharged through the discharge channel 197. As a result, adhesion of the waste ink 300 to the guide member 193 of the cap holder 93 and dropping of the waste ink 300 within the image forming apparatus 100 are securely prevented.

Thus, when the cap holder 93 is retracted to remove the suction cap 91 from the nozzle face 124 of the recording head 24, the suction cap 91 is removed from the nozzle face 124 before the induction member 195 is removed therefrom. Accordingly, the induction member 195 protrudes toward the recording head 24 beyond the contact portion 91*a* of the suction cap 91 to receive the waste ink 300 dropping from the suction cap 91. Therefore, in the recording head 24 in which the nozzle face 124 is disposed vertically, the waste ink 300 dropping from the suction cap 91 upon removal of the suction cap 91 from the nozzle face 124 is prevented from adhering to the cap holder 93 or the like.

Figure 7A:
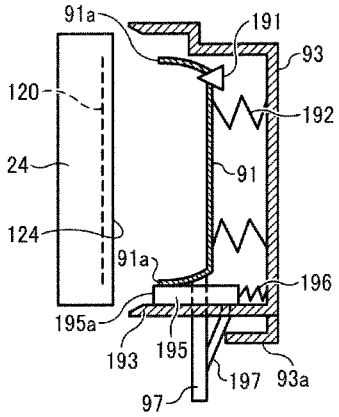
FIGS. 7A and 7B are schematic views respectively illustrating an example of a configuration of a capping mechanism provided to a servicing mechanism of an image forming apparatus according to a second illustrative embodiment.
Figure 7B:
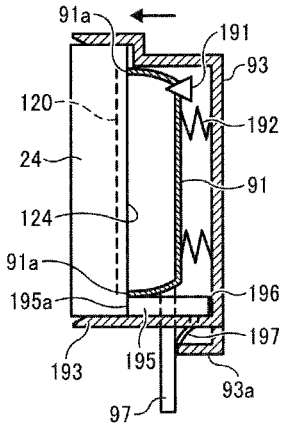

A description is now given of a configuration and operation of the servicing mechanism 9 according to a second illustrative embodiment with reference to FIGS. 7A and 7B. FIGS. 7A and 7B are schematic views respectively illustrating an example of a configuration of the capping mechanism included in the servicing mechanism 9 according to the second illustrative embodiment.

In the second illustrative embodiment, the suction/discharge channel 97 connected to the suction cap 91 and the discharge channel 197 connected to the induction member 195 are connected to each other in the middle of the suction/discharge channel 97 so that the waste ink 300 discharged from the discharge channel 197 is also discharged to the waste tank 98 through the suction/discharge channel 97. Accordingly, disposition of the discharge channel 197 is facilitated.

In addition, the cap holder 93 has an open and close member, which, in the second illustrative embodiment, is a protrusion 93*a* that opens or closes the discharge channel 197.

When the cap holder 93 is positioned at the retracted position, the protrusion 93*a* of the cap holder 93 opens the discharge channel 197 as illustrated in FIG. 7A. By contrast, when the cap holder 93 is moved toward the recording head 24 so that the nozzle face 124 is capped with the suction cap 91, the protrusion 93*a* presses against the discharge channel 197 to block the discharge channel 197 as illustrated in FIG. 7B.

Thus, the discharge channel 197 connected to the suction/discharge channel 97 is closed while the nozzle face 124 is capped with the suction cap 91. Accordingly, suction pressure from the suction pump 96 acts fully on the sealed space within the suction cap 91, thereby sucking out the waste ink 300 from the suction cap 91.

Figure 8A:
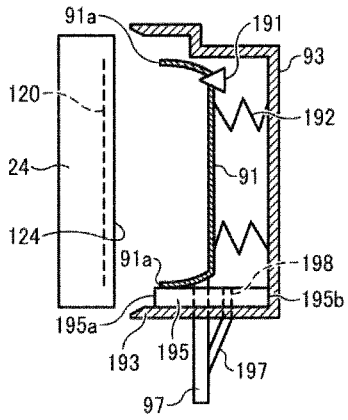
FIGS. 8A and 8B are schematic views respectively illustrating an example of a configuration of a capping mechanism provided to a servicing mechanism of an image forming apparatus according to a third illustrative embodiment.
Figure 8B:
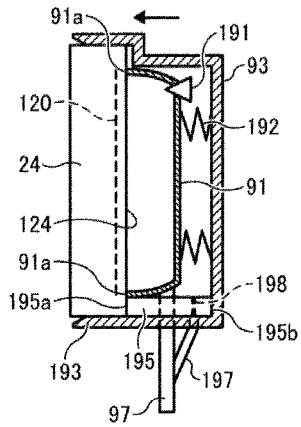

A description is now given of a configuration and operation of the servicing mechanism 9 according to a third illustrative embodiment with reference to FIGS. 8A and 8B. FIGS. 8A and 8B are schematic views respectively illustrating an example of a configuration of the capping mechanism included in the servicing mechanism 9 according to the third illustrative embodiment.

In a manner similar to the second illustrative embodiment, the suction/discharge channel 97 connected to the suction cap 91 and the discharge channel 197 connected to the induction member 195 are connected to each other in the middle of the suction/discharge channel 97 so that the waste ink 300 discharged from the discharge channel 197 is also discharged to the waste tank 98 through the suction/discharge channel 97. Accordingly, disposition of the discharge channel 197 is facilitated.

In addition, in the third illustrative embodiment, the induction member 195 is formed of an elastic material and has an opening 198 connected to the discharge channel 197. A second face 195*b* of the induction member 195 opposite the contact face 195*a* is fixed to the cap holder 93.

The opening 198 of the induction member 195 is opened when the cap holder 93 is positioned at the retracted position as illustrated in FIG. 8A. By contrast, when the cap holder 93 is moved toward the recording head 24 so that the nozzle face 124 is capped with the suction cap 91, the induction member 195 is pressed between the nozzle face 124 and the cap holder 93 to close the opening 198 as illustrated in FIG. 8B.

Thus, the discharge channel 197 is closed upon close of the opening 198 while the nozzle face 124 is capped with the suction cap 91. Accordingly, suction pressure from the suction pump 96 acts fully on the sealed space within the suction cap 91, thereby sucking out the waste ink 300 from the suction cap 91.

Figure 9:
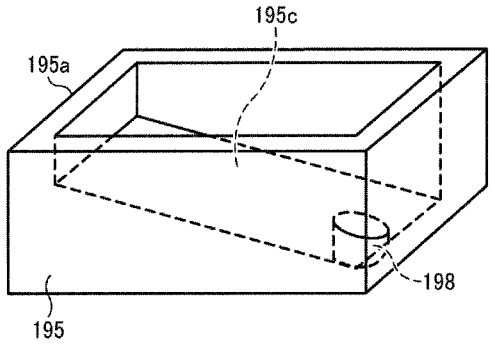
FIG. 9 is a perspective view illustrating an example of a configuration of an induction member included in an image forming apparatus according to a fourth illustrative embodiment.

A description is now given of a configuration and operation of the induction member 195 according to a fourth illustrative embodiment with reference to FIG. 9. FIG. 9 is a perspective view illustrating an example of a configuration of the induction member 195 according to the fourth illustrative embodiment.

The induction member 195 has a sloped bottom surface 195*c* tilting downward from the contact face 195*a* to the opening 198.

Accordingly, the waste ink 300 flowing in the induction member 195 is more easily inducted to the opening 198. It is to be noted that the sloped bottom surface 195*c*, if made water-repellant, can more easily guide the waste ink 300 to the opening 198.

The present illustrative embodiment is also applicable to a configuration in which the sheet 10 is conveyed in a direction at an angle to the vertical direction and ink droplets are ejected in a direction at an angle to the horizontal direction. It is to be noted that the foregoing illustrative embodiments are applicable not only to the serial-type image forming apparatuses but also to line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplarys are not to be regarded as a departure from the scope of the present invention, and all such s as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

a recording head having an array of nozzles disposed on a nozzle face of the recording head to eject liquid droplets from the nozzles, the nozzle face of the recording head arranged vertically in the image forming apparatus;

a suction cap to cover the nozzle face of the recording head, the suction cap having a contact portion to contact the nozzle face of the recording head;

a cap holder movable relative to the recording head to movably hold the suction cap, the cap holder having:

an elastic member connected to the suction cap; and a guide member to slidably contact a lower outer wall of the recording head;

an induction member provided between a lower inner wall of the cap holder and a lower outer wall of the suction cap to receive liquid dropping from the suction cap; and a discharge channel connected to the induction member through which the liquid retained by the induction member is discharged externally, wherein the suction cap is first removed from the nozzle face of the recording head while the induction member still remains in contact with the nozzle face of the recording head so that the induction member receives liquid dropping from the suction cap upon retraction of the cap holder from the recording head.

2. The image forming apparatus according to claim 1, further comprising a biasing member provided between the cap holder and a first face of the induction member opposite a second face facing the recording head, the biasing member biasing the induction member toward the recording head.

3. The image forming apparatus according to claim 2, wherein the induction member comprises a sloped surface sloping downward to the discharge channel from the second face that contacts the nozzle face of the recording head.

4. The image forming apparatus according to claim 1, wherein at least a part of the induction member that contacts the nozzle face of the recording head is formed of an elastic material.

5. The image forming apparatus according to claim 1, further comprising a suction/discharge channel connected to the suction cap and to a suction unit, wherein the discharge channel connected to the induction member is connected to the suction/discharge channel.

6. The image forming apparatus according to claim 5, wherein the cap holder further comprises an open and close member to open or close the discharge channel connected to the induction member.

* * * * *